United States Patent [19]

Albrechtson et al.

[11] Patent Number: 4,593,228

[45] Date of Patent: Jun. 3, 1986

[54] LAMINATED ELECTROLUMINESCENT LAMP STRUCTURE AND METHOD OF MANUFACTURING

[76] Inventors: Loren R. Albrechtson, 5216 Militia La., Columbus, Ohio 43230; Robert B. Reif, 2633 Suann Ave., Grove City, Ohio 43123; William B. Thompson, 3737 Lindhurst Rd., Columbus, Ohio 43220

[21] Appl. No.: 610,427

[22] Filed: May 15, 1984

[51] Int. Cl.[4] ..... H01J 1/62; B05D 5/06; B05D 5/12

[52] U.S. Cl. ..... 313/509; 313/512; 427/66

[58] Field of Search ..... 313/509, 512; 427/66

[56] References Cited

U.S. PATENT DOCUMENTS

| | | | |
|---|---|---|---|
| 2,838,715 | 6/1958 | Payne | 313/494 |
| 2,840,741 | 6/1958 | Lehmann | 313/502 |
| 2,944,177 | 7/1960 | Piper | 313/502 |
| 2,951,169 | 8/1960 | Faria et al. | 313/502 |
| 3,023,338 | 2/1962 | Cerulli | 313/502 |
| 3,070,722 | 12/1962 | Bouchard | 313/502 |
| 3,177,391 | 4/1965 | Devol et al. | 313/512 |
| 3,205,393 | 9/1965 | Mash | 313/509 |
| 3,219,865 | 11/1965 | Vodicka | 313/509 |
| 3,238,407 | 3/1966 | Jaffe | 313/502 |
| 3,243,629 | 3/1966 | Levetan | 427/66 |
| 3,246,193 | 4/1966 | Dickson et al. | 313/510 |
| 3,281,619 | 10/1966 | Greene | 313/510 |
| 3,350,596 | 10/1967 | Burns | 313/502 |
| 3,379,915 | 4/1968 | Sentementes et al. | 313/509 |
| 3,509,401 | 4/1970 | Calley et al. | 313/512 |
| 4,020,389 | 4/1977 | Dickson et al. | 315/246 |

*Primary Examiner*—David K. Moore
*Assistant Examiner*—William L. Oen
*Attorney, Agent, or Firm*—Robert B. Watkins

[57] ABSTRACT

The improvement in an electroluminescent lamp and the method of making same, including providing a polymer on the lamp structure and encapsulating the lamp with the polymer in a hard surface moisture impervious layer on each side of the device through the application of pressure and heat at selected conditions of pressure and temperature.

7 Claims, 3 Drawing Figures

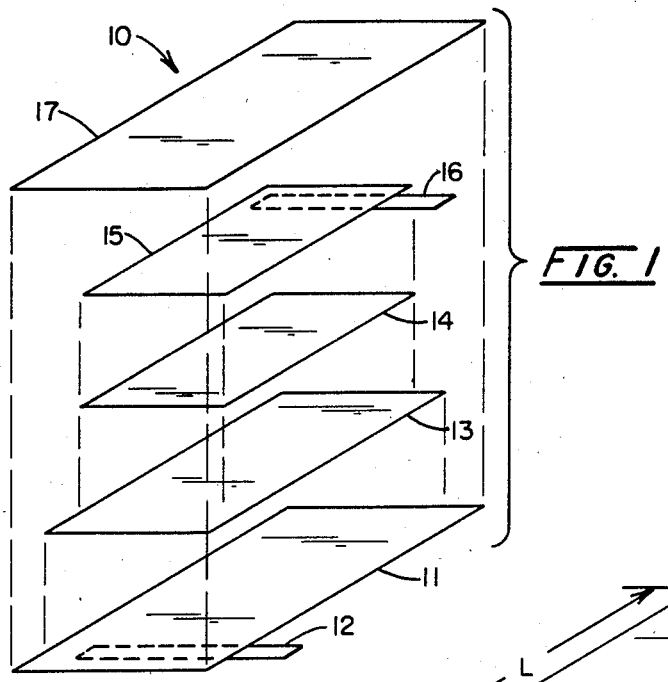
FIG. 1
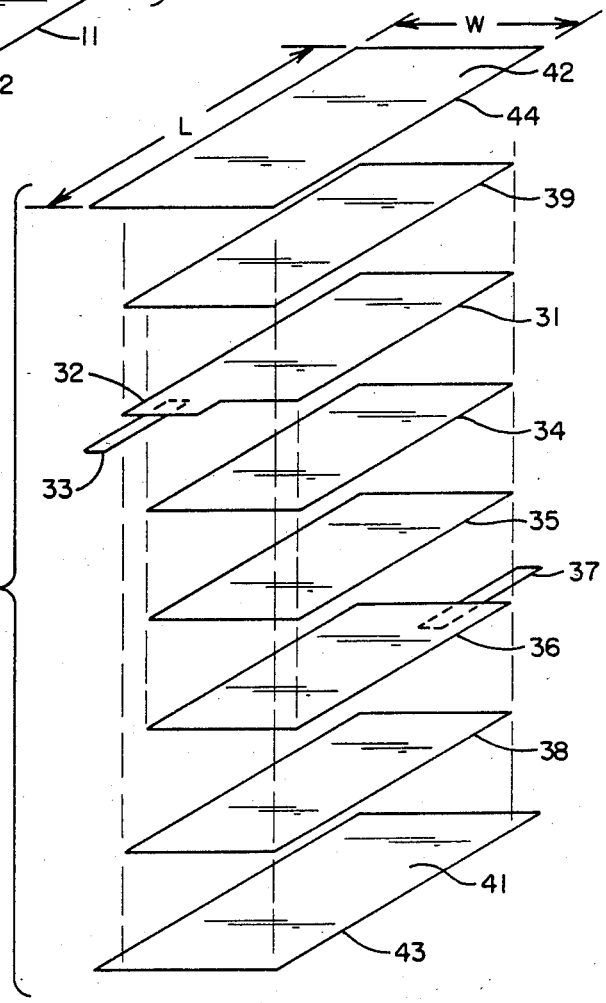
FIG. 2
FIG. 3
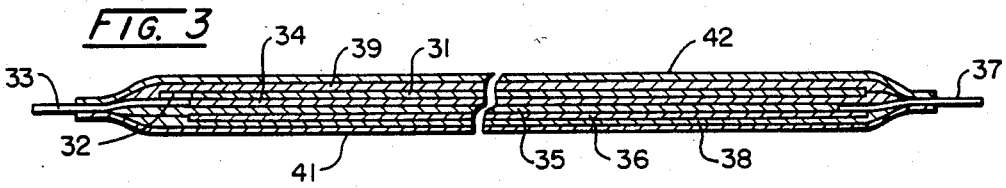

LAMINATED ELECTROLUMINESCENT LAMP STRUCTURE AND METHOD OF MANUFACTURING

FIELD OF THE INVENTION

The present invention concerns an electroluminescent lamp structure, and more particularly pertains to a thick film electroluminescent lamp structure of the flexible matrix type comprising sandwiched overlays of conductive films and electroluminescent films, typically phosphors.

BACKGROUND OF THE INVENTION

Conventional thick film electroluminescent (hereinafter to be referred to as EL) lamps are formed in the manner to be described below. Generally speaking, the term "thick film" EL lamps refers to lamps in which the electroluminescent materials are deposited in films not more than about one and a half to two mils thick. They are distinguished from "thin" film EL lamps in which the films are deposited by evaporative deposition and are in the range of about one to four microns thick.

This invention will be described herein with respect to thick film EL lamp structures. In the conventional construction, the lamp was made by applying successive coatings on an aluminum back electrode. A barium titanate layer is applied first; followed by a phosphor layer, and finally a layer of indium oxide. The barium titanate (such as General Electric Barium Titanate Suspension 117-3-7) and indium oxide (such as General Electric Indium Oxide Suspension 117-3-16) layers are made with commercial suspensions with a CNEC binder (such as supplied by General Electric Corporation). Each coating layer is dried. After drying, lead terminals are attached to the indium oxide layer and aluminum back electrode. The resulting assembly is sealed in a moisture-resistant film, such as a transparent polymer film.

Such a conventional thick film EL structure has the drawback that, when the structure is taken out into the air after drying during the manufacturing process, for the purpose of being sealed, the assembly absorbs the moisture contained in the air; and further that, owing to the moisture located within the device, the service life of the device is markedly reduced. Nevertheless, in spite of these drawbacks, various patents have been granted on the construction of EL lamps including the following:

U.S. Pat. No. 2,838,715—Payne, concerns the construction of an EL lamp comprising a first electrode, a second electrode in close proximity, a solid layer between the electrodes including an electroluminescent phosphor. At least one of the electrodes has a light transmitting conductive solid in close contact within the phosphor layer. U.S. Pat. No. 2,840,741—Lehmann, enhanced the light output of the cell by aligning the phosphor particles in the dielectric.

U.S. Pat. No. 2,944,177—Piper, shows a process and construction for improving the maintenance characteristics of an electroluminescent cell by encapsulating phosphor particles in glass and suspending the encapsulated particles in a dielectric binder. In U.S. Pat. No. 2,951,169—Faria et al., the phosphor is coated with colloidal transparent silica to minimize the decrease in the efficiency of the device with increasing field strength.

U.S. Pat. No. 3,023,338—Cerulli, reveals a copper compound added to copper-activated zinc sulfide phosphor and mixed them with a fine glass frit. When the mix is fired at a temperature lower than required to crystallize the matrix for copper-activated zinc sulfide phosphor, the continuous layer formed electroluminescence evenly and brightly. In U.S. Pat. No. 3,238,407—Jaffe, an improved electroluminescent cell is provided by using a high dielectric binder such as cyanoethyl polyglucoside.

U.S. Pat. No. 3,070,722—Bouchard, discloses a means for reducing the deterioration of the light output of a lamp by providing a hermetically-sealed plastic enclosure for the lamp. U.S. Pat. No. 3,246,193—Dickson, Jr. et al., reveals a continuous layer of electroluminescent phosphor used in a dielectric material applied to a conductive substrate. The second electrode consists of a metallic material such as aluminum, gold, or silver, applied in the desired pattern on the phosphor layer by an acceptable means such as vacuum deposition.

U.S. Pat. No. 3,281,619—Green, reveals the edge terminated type of display device. This insures that the leads to the electrode sections will not capacitively couple to the light-transmitting electrode when a potential is applied. U.S. Pat. No. 3,350,596—Burns, shows a device in which a semi-conductor such as tin chloride is used in both electrodes to even out the field in the phosphor layer and allow a voltage of the order of the breakdown voltage to be applied to the entire layer.

U.S. Pat. No. 4,020,389—Dickson et al., reveals a flexible electroluminescent lamp consisting of a three-layer sandwich of a thin film metal between layers of a thin film dielectric deposited on a polymeric substrate. The phosphor in a suitable binder system was coated on an aluminum substrate to form the other electrode. The assembled members are adhered together by passing them between heated rollers.

SUMMARY OF THE INVENTION

In summary, this invention is an improvement in EL devices comprising the application of a waxy polymer film on at least one side of the device and then applying an additional film of a hard surface moisture impervious material to the surface of the waxy polymer to form a moisture vapor resistant outer encapsulating envelope on the device.

The invention includes the process of assembling the device with the improvement envelope in place. The process includes the steps of assembling the device while heated in an oven; then applying pressure upon the whole surface, heat sealing and bonding the films to both sides of the lamp; following which carrying out the additional step of further heat sealing the edges at a higher temperature with an application of pressure for a period of time.

It is therefore the object of the present invention to provide a thick film EL structure having a markedly prolonged service life by reducing the moisture contained in the structure and reducing moisture vapor penetration; and also to provide a method of manufacturing such structure. It has been determined that electroluminescent lamps that have not been thoroughly dried and then sealed degrade rapidly due to the moisture in the lamp. According to the present invention, degradation due to moisture is greatly reduced in a preferred embodiment by the placement of a sheet of about 5 mil PARAFILM-M TM (a waxy polymer manufactured by the American Can Company, Greenwich, Conn. 68030) on each side; and then adding sheets of about 7.5 mil ACLAR 22 TM (a hard surface moisture impervious fluorinated chlorinated resin film, manufactured by Allied Chemical Corporation, Morristown, N.J. 07960), to form the final outer envelope of the lamp.

In the preferred process the encapsulation materials are assembled while heated in a oven at about 212° F. (100° C.) and then transferred while still hot to a heat sealer at about 250° F. (121° C.). At this temperature a pressure of 50 psi is applied over the whole lamp to bond the Aclar films to both sides of the lamp. The edges of the lamp are then heat sealed again at about 600° F. (317° C.) with a pressure of about 50 psi applied for about 3 seconds.

The foregoing and other advantages of the invention will become apparent from the following disclosure in which preferred embodiment of the invention are described in detail and illustrated in the accompanying drawings. It is contemplated that variations in procedures, structural features and arrangement of parts may appear to the person skilled in the art, without departing from the scope or sacrificing any of the advantages of the invention.

BRIEF DESCRIPTION OF THE DRAWINGS

FIG. 1 is an exploded perspective view of a conventional embodiment of a thick film EL lamp using, in this case, an aluminum electrode, with parts separated apart form each other for the convenience of explanation.

FIG. 2 is an exploded perspective view of another embodiment of a thick film EL lamp having the improvement of this invention to show a specific example, with parts separated apart from each other for the convenience of explanation.

FIG. 3 is an enlarged cross-sectional view of the EL lamp of this invention, showing the relationship of the layers.

BEST MODE OF CARRYING OUT THE INVENTION

Referring to FIG. 1, a conventional electroluminescent device 10 is constructed of laminated layers of operative materials, including an electroluminescent material such as a phosphor. The laminated layers in combination cause the electroluminescent material to luminese upon the application of electric power to an upper and lower operative layer of material.

A portion of aluminum foil, of a thickness of typically 5.5 mils, forms the base layer 11 and is provided with an aluminum foil electrode 12, typically 1.1 mils thick. The electrode 12 is connected to the aluminum foil 11 with an electrically conductive connection such as a solder or conductive cement. A coating of dielectric/resistant material 13 typiclly a Barium Titanate, is applied on the base layer 11. The layer 13 may be of the formulation 117-3-7 as designated by the General Electric Company of Cleveland, Ohio.

The coating 13 is applied by screen process printing or by spreading and doctoring between lateral strips of polyester tape, typically 2 mils thick, which are arranged rectangularly upon the substrate below. The thickness of the tapes defines the thickness of the layer when the material is spread by a doctor blade resting upon the tape. After the layer 13 is dried, a layer of electroluminescent material 14, typically phosphor, is applied in a binder from a suspension such as DMF. The layer is applied and doctored into place as previously described for the underlying layer. A conductive window layer 15 is applied upon the electroluminescent layer 14. The conductive layer may be a layer of translucent material such as indium oxide in a suspension "117-1-14", manufactured by the General Electric Co., Cleveland, Ohio. An aluminum foil electrode 16 is connected to the layer 15 at one side. A moisture resistive film 17, such as a transparent polymer film, is applied on the top.

Referring to FIGS. 2 and 3, an electroluminescent device, including the improvement of this invention, is constructed of a conducting translucent film material 31, typically 5 mils thick, sold under the trademark Intrex K by Sierracin Corporation, Sylmar, Calif. The material 31 is provided with an extension portion 32 to which an electrode 33 is electrically/conductively connected. The electrode is an extension of stainless steel wire cloth (325 by 325 ss), and may be manufactured by Advances Process Supply Company, of North Chicago, Ill. Other extension electrode materials could be used.

The description which follows relates to the preferrable procedure of "building" the EL lamp from the "top down"; i.e., by the application of successive layers on a transparent conductive film material 31. This is preferred because a phosphor layer 34 can be applied and bonded to the clear conductive layer 31 while the phosphor layer contains the solvent. Therefore, no additional adhesive is required. However, the improvement of this invention could be applied on lamps which are built from the "bottom up" using an adhesive to bond the transparent conductive film to the polymer layers.

In the procedure from the "top down", a dielectric/resistant layer of material 35, such as barium titanate, 2 mils thick, is applied over the phosphor layer 34. A 1 mil conductive coating material layer 36 is applied over the dielectric/resistant layer 35 to as the bottom electrode. An attachment piece of stainless steel screen 37 is embedded in the conductive coating layer and acts as a connector to the power input. In an example device the conductive coating material 36 was a silver impregnated epoxy named Eccocoat CC-40-A TM, manufactured by Emerson and Cuming, Inc. of Canton, Mass.

Alternatively, the EL lamp may be built up from an aluminum foil bottom electrode. The conductive window film material 31 is applied to the phosphor layer 34 by heat and pressure on a thermoplastic polyurethane binder which contains the phosphor. With binder concentrations of 5, 10, 15, 30, and 40 percent, the conductive window is attached by heating to between 300° to 350° F. (148°–176° C.) and pressing with a flat platten or rubber-covered roll under pressures of 1000 to 2000 psi. It has been found that the best light output of 30 to 35 fL (foot lamberts) was achieved when the binder percent was about 10 percent. The light output decreased to 30, 20, and 15 fL in devices with 15, 30, and 40 percent binder.

In still another alternative construction, the transparent conductive film 31 is attached to phosphor layer 34 containing 10 percent cyanoethyl cellulose (CNEC) binders by means of adhesives. Various adhesives, such as silicone rubber, cyanoacrylate, urethane resin, and polyethylene adhesives, were successfully used. Preferably, however, epoxy adhesives were found to provide the most brightness.

In accordance with the improvement of this invention, a translucent or transparent polymer of a waxy constituency is applied by the application of films 38, 39 on each side of the device. In a preferred embodiment, the polymers 38, 39 were 5 mil thick. To complete the device, a hard surface moisture impervious material or encapsulating layer 41, 42 is applied to each side of the device and laminated to the polymer 38, 39, respectively. The encapsulating layer is constructed of larger lateral dimensions L, W than the other layers, so that when the lamps are finally assembled the edges 43, 44 of the encapsulating layers 41, 42 extend beyond the edges of the internal lamp structure.

In the process of assembling the lamp, all of the materials are assembled while heated in an oven at about 212° F. (100° C.) to drive out all moisture. The device is then transferred while still hot to a sealing apparatus which is maintained at about 250° F. (121° C.) where a pressure of about 50 psi is applied over the whole lamp surface for about three seconds to bond the encapsulating layers 41, 42 to both sides of the device. The extended edges, 43, 44 typically 2–5 mm, around the EL device, are then heat sealed at a temperature of about 600° F. (317° C.) and a pressure of about 50 psi for about three seconds. While the device is still hot, the border may be trimmed to an appropriate size. In a typical example lamp the constructed total thickness was about 33 mils or 0.8 mm.

A number of unsealed lamps, made according to the description and process of FIG. 1, were air dried for about one hour and then baked at 212° F. (100° C.) for one half hour. After 115 volts at 400 Hz was applied for seven to ten hours, the lamps darkened. The brightest lamps made with the thinnest phosphor layers darkened most rapidly.

Various lamps were made without the encapsulating films of this invention and tested together with other example lamps having the encapsulation layers and processes applied according to this invention. In these testing procedures, it was found that as test periods were increased, the binder in the unsealed lamps began to turn brown or black and the brightness decreased rapidly. Since this was conceived to be the effect of moisture, various tests were performed to confirm the cause of the darkening of the binder.

A number of unsealed test lamps were made with Intrex conductive films 31, Eccocoat CC-40-A conductive films 36, and CNEC binder concentrations of 2.5 to 30 percent in the electroluminescent coating 34. The lamps were air dried for one hour and then baked at 212° F. (100° C.) for one half hour. After 115 volts at 400 Hz was applied for 7 to 10 hours, all of the lamps darkened. The brightest lamps made with thin phosphor layers darkened most rapidly. At the same time, a lamp with 10 percent CNEC was desiccated for one half hour before power was applied. The lamp showed little darkening after power was applied for 17 hours. However, the lamp turned dark in two to three minutes when power was applied after 48 hours of exposure to room conditions, where the relative humidity was about 40 to 50 percent.

Three unsealed test lamps also were placed in relative humidities of 0, 50, and 100 percent and conditioned over night. When power was applied, the lamp at 100 percent relative humidity shorted out in 10 minutes. The lamp at 50 percent relative humidity discolored noticeably after one hour, turned darker after two days, and shorted out the fifth day. The lamp in the dry chamber darkened only slightly after two days but did not change in the next four days.

Subsequently, test lamps were encapsulated in hard surface moisture impervious material envelopes for moisture protection. They were then heat sealed at 550° F. (287° C.), and a pressure of 70 psi was applied for three seconds. These lamps darkened in one hour after being exposed to room conditions overnight.

In subsequent further test lamps, moisture vapor transmission between the lamp and the moisture impervious film was substantially reduced by applying a sheet of waxy polymer between the EL device and the film on each side of the lamp.

The device was oven dried at 212° F. (100° C.) for 15 minutes and the moisture impervious film was sealed over the entire lamp and electrodes by heating to 250° F. (121° C.) and pressing at 50 psi for three seconds. When 100 volts at 400 Hz was applied for 12 hours at room conditions, little darkening was observed on the sealed lamps.

Subsequently, the edge sealing temperature was increased to 600° F. (317° C.) to improve the bond between the encapsulating films at each side.

From the foregoing test results it will be seen that the process of encapsulating devices, and devices having encapsulation, according to this invention, are superior in performance and improved in life characteristics.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

We claim:

1. In an electroluminescent device comprising operative materials including a conductive window layer with an electroluminescent material layer applied thereto, a dielectric resistant material layer applied thereto, and a conductive layer applied thereto, the improvement comprising:

a. a layer of waxy polymer laminated on each side of the operative materials of the device, and b. a layer of hard surface moisture impervious resin material laminated and heat sealed on the outside of the polymer layers and around the outside edges of the device, to form a moisture impervious and encapsulated unified assembly substantially free of moisture.

2. The improvement according to claim 1 wherein the hard surface moisture resistant material is a fluorinated chlorinated resin film.

3. The improvement according to claim 1 wherein the waxy polymer layer is about 5 mils thick and the layer of hard surface moisture impervious resin material is about 7.5 mils thick.

4. The method of manufacturing an electroluminescent device including sequentially:

(1) In a heated oven;

a. Applying an electroluminescent material upon a translucent conductive film material;

b. applying a dielectric/resistance material upon the electroluminescent material;

c. applying a conductive coating material upon the dielectric/resistance material;

d. applying a waxy polymer material on both sides of the assembly of a, b, and c and encapsulating the device by laminating a hard surface moisture impervious material upon each side of the device; and (2) Removing the assembly from the heated oven and while still heated applying a pressure upon the surface of each side of the assembly thereby, heat sealing and bonding the waxy polymer and encapsulating layers to each side of the device.

5. The process according to claim 4 wherein the device is further heat sealed at the edges by the application of additional pressure while maintaining the device at an elevated temperature.

6. The process according to claim 4 wherein the oven temperature is about 212° F. (100° C.), and step (2) is carried out by applying a pressure of about 50 psi upon the surface of each side.

7. The process acording to claim 6 wherein the device is further heat sealed at the edges by the application of pressure of about 50 psi while maintaining the device at a temperature of about 600° F. (121° C.) for a period of about three seconds.

* * * * *